US006644662B1

(12) United States Patent
Cao et al.

(10) Patent No.: US 6,644,662 B1
(45) Date of Patent: Nov. 11, 2003

(54) BILLIARD TYPE GAME SYSTEM

(76) Inventors: Brian Cao, 1247 N. June St. #10, Los Angeles, CA (US) 90038; Katherine Nguyen, 1247 N. June St. #10, Los Angeles, CA (US) 90038

( * ) Notice: Subject to any disclaimer, the term of this patent is extended or adjusted under 35 U.S.C. 154(b) by 0 days.

(21) Appl. No.: 10/280,696

(22) Filed: Oct. 25, 2002

(51) Int. Cl.[7] ..... A63F 7/00; A63D 15/00
(52) U.S. Cl. ..... 273/123 R; 473/20
(58) Field of Search ..... 273/118 R, 119 R, 273/122 R, 123 R, 125 R; 473/20

(56) References Cited

U.S. PATENT DOCUMENTS

| | | | | | |
|---|---|---|---|---|---|
| 290,360 | A | * | 12/1883 | Schlueter | 273/123 R |
| 736,938 | A | | 8/1903 | Clark | |
| 1,221,181 | A | * | 4/1917 | Hooper | 273/317.2 |
| D66,386 | S | | 1/1925 | Trost | |
| 2,941,807 | A | * | 6/1960 | Letbetter | 273/118 R |
| 3,848,872 | A | * | 11/1974 | Velissaris | 273/125 R |
| 4,004,804 | A | | 1/1977 | Gholson | |
| 4,039,191 | A | * | 8/1977 | Breslow | 273/125 R |
| 4,114,876 | A | * | 9/1978 | Maruszak | 273/108.21 |
| 4,610,450 | A | * | 9/1986 | Howell | 473/18 |
| 4,874,167 | A | * | 10/1989 | Hillard | 473/14 |
| 5,116,048 | A | * | 5/1992 | Bilocer kowycz et al. | 273/108.21 |
| 5,765,828 | A | * | 6/1998 | Baker et al. | 273/108.2 |
| 6,068,558 | A | | 5/2000 | Gill et al. | |

* cited by examiner

*Primary Examiner*—Raleigh W. Chiu
(74) *Attorney, Agent, or Firm*—Goldstein & Lavas, P.C.

(57) ABSTRACT

A billiard type game system for playing a billiard type game on a game table. The game table has a table top which is defined by rails, consecutively numbered vertical pockets extending through the table top, a corresponding bumper for each pocket, and sets of color coded numbered balls. The pockets are scattered around the table top and are located away from the rails. Each pocket has a bumper positioned adjacent to the pocket, and an indicator also positioned adjacent to each pocket. The indicators serve as starting points from which the balls are hit across the table top towards the next consecutively numbered appropriate pocket. The object of the game is to the sink each of the balls of a player into the appropriate pockets according to a specified order.

4 Claims, 3 Drawing Sheets

BILLIARD TYPE GAME SYSTEM

BACKGROUND OF THE INVENTION

The invention relates to a billiard type game system. In particular, the invention is a game that is played on a modified billiard table, wherein the object of the game is to sink a specified number of balls into a specified number of pockets in a preselected order. The winner of the game is determined by the first player to successfully sink all of his balls into the appropriate pockets in the correct order.

Games are a favorite pastime of people of all ages. One extremely popular game is billiards. Billiards is played on a table having a flat playing surface and holes in the corners known as "pockets". Balls are placed on the table and hit into the pockets using a cue stick. Many variations of billiards have evolved over the years to offer people alternatives to the standard game. The variations include the use of bumpers on the table top, as well as variations in play such as using different numbers of balls and varied methods of scoring.

U.S. Pat. No. 6,068,558 to Gill et al. Discloses a hexagonal billiard-type game having a table top place with a hexagonal configuration. The game includes a plurality of balls, cue sticks, and a rack also having a hexagonal configuration.

U.S. Pat. No. 4,004,804 to Gholson discloses a game apparatus that simulates a combination of golf and pool.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved billiard type game system. As such, the general purpose of the present invention, which will be described subsequently in greater detail, is to provide a new and improved billiard type game system which has all of the advantages of the prior art and none of the disadvantages.

To attain this, the present invention essentially comprises a billiard type game system for playing a billiard type game on a game table. The game table has a table top which is defined by rails, consecutively numbered vertical pockets extending through the table top, a corresponding bumper for each pocket, and sets of color coded numbered balls. The pockets are scattered around the table top and are located away from the rails. Each pocket has a bumper positioned adjacent to the pocket, and an indicator also positioned adjacent to each pocket. The indicators serve as starting points from which the balls are hit across the table top towards the next consecutively numbered appropriate pocket. The object of the game is to the sink each of the balls of a player into the appropriate pockets according to a specified order.

It is an object of the invention to produce a billiard type game system that allows at least two players to engage in the game. Accordingly, the system includes sets of balls with which the players use during the game. Each player chooses one set of color-coded balls at the start of the game. The game is won by the first player to sink all of his balls into appropriate pockets in the correct sequence.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
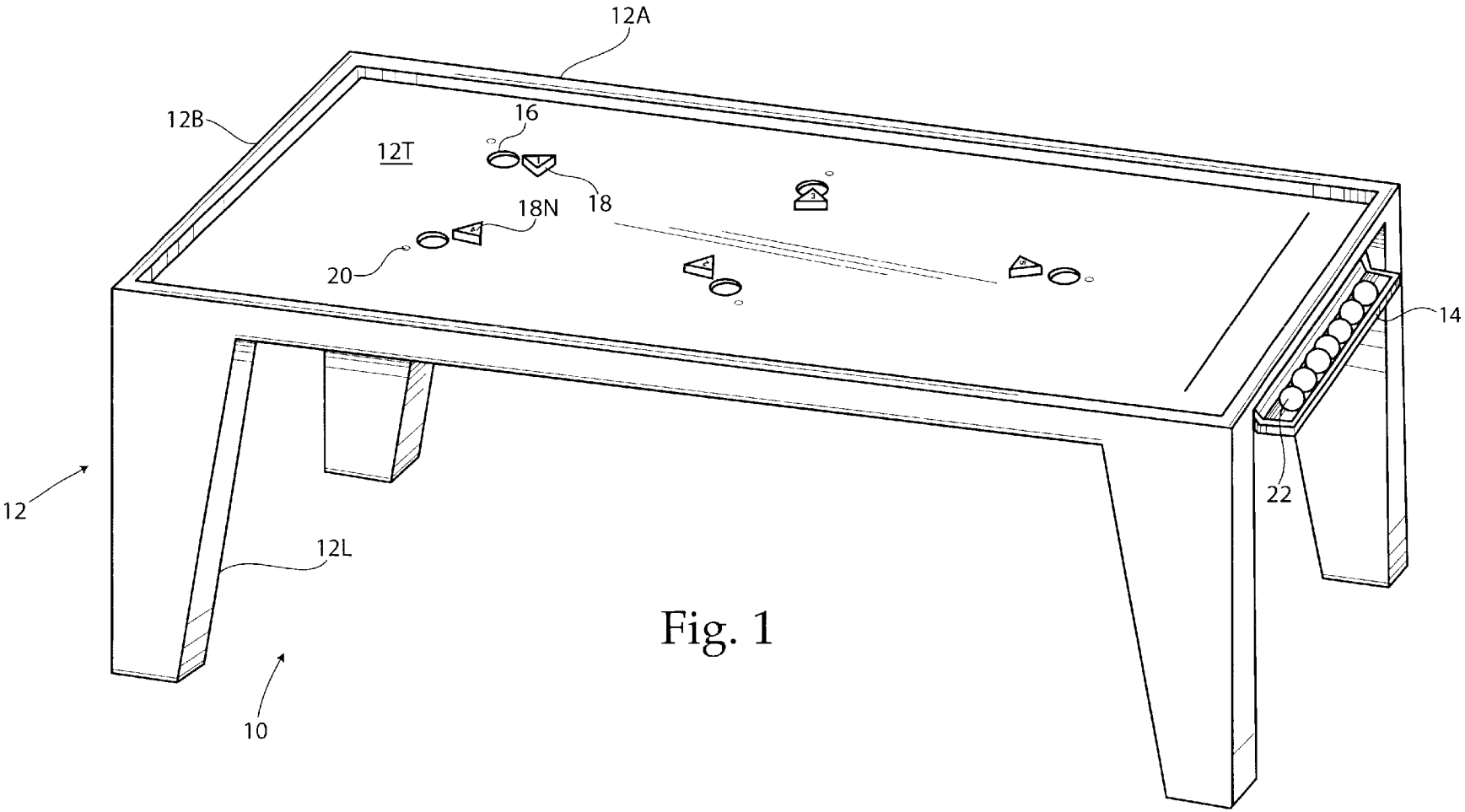
FIG. 1 is a perspective view of the billiard type game table.
Figure 2:
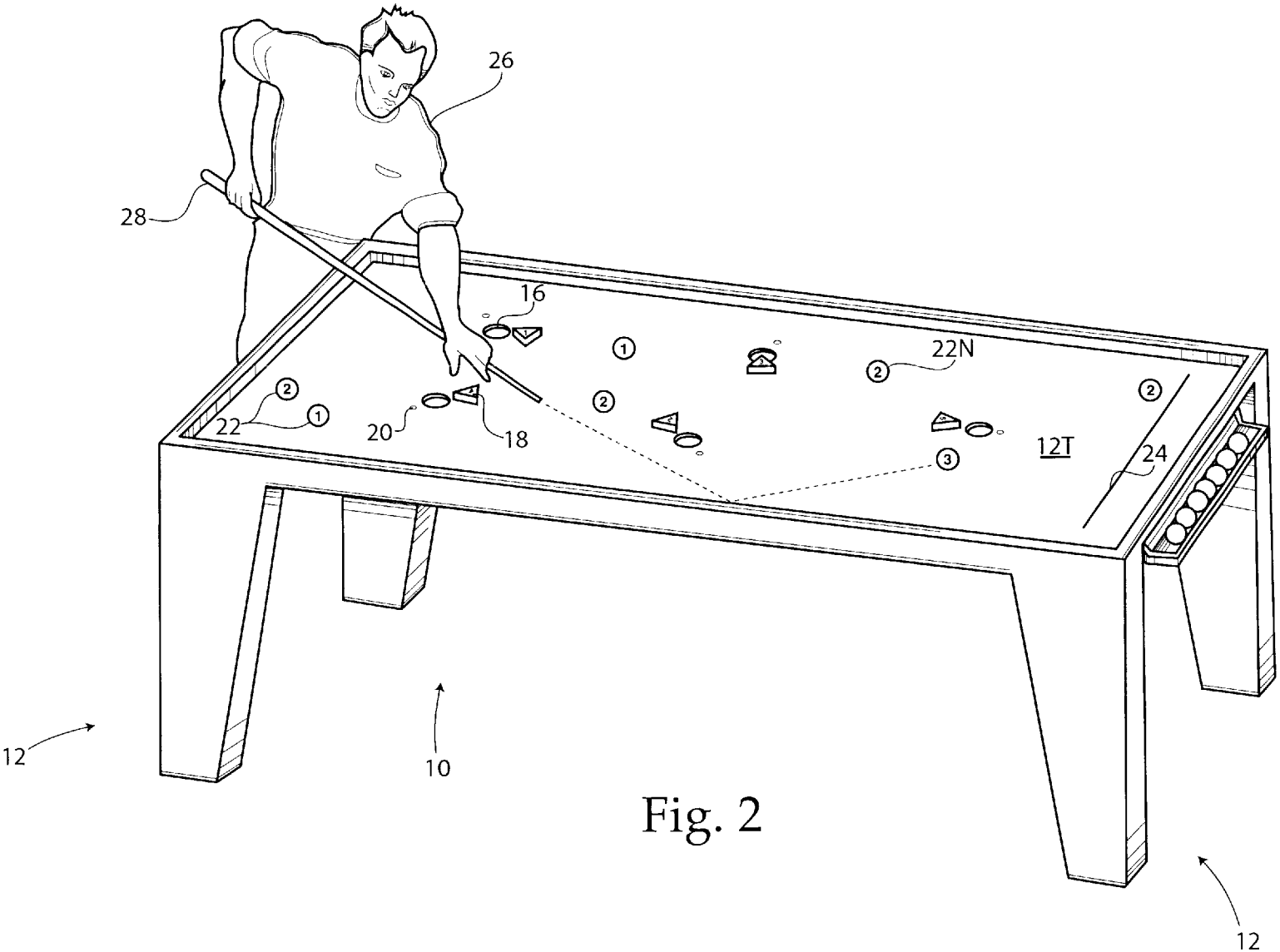
FIG. 2 is a perspective view of the billiard type game system, illustrating a player using a cue stick to hit one of the balls.

| REFERENCE NUMERALS | |
|---|---|
| 10 | billiard type game apparatus |
| 12 | game table |
| 12L | table leg |
| 12T | table top |
| 12A | table long rail |
| 12B | table short rail |
| 14 | ball retrieval bin |
| 14L | ball retrieval bin outer lip |
| 16 | pocket |
| 18 | bumper |
| 18N | bumper number |
| 20 | indicator |
| 22 | ball |
| 22N | ball number |
| 24 | starting line |
| 26 | player |
| 28 | cue stick |
| 30 | shelf |

DETAILED DESCRIPTION OF THE PREFERRED EMBODIMENTS

FIG. 1 illustrates a billiard type game system 10 for playing a billiard type game on a game table 12. The game table 12 generally has four legs 12L and a table top 12T, the table top 12T being covered with a cloth felt material. The table 12 is preferably rectangular shaped, having a pair of long rails 12A and a pair of short rails 12B. A ball retrieval bin 14 is positioned along one of the short rails 12S, below the table top 12T. The game system 10 essentially comprises a plurality of vertical pockets 16 in the table top 12T, a corresponding bumper 18 for each pocket 16, and a plurality of color coded balls 22, wherein the object of the game is the sink each of the balls 22 into the appropriate pockets 16 according to a specified order.

The table 12 further comprises a ball catching structure, the structure extending below the table top 12T and connected to the ball retrieval bin 14, as illustrated in FIG. 4. While the structure may take various forms, a shelf 30 is used for illustrative purposes. When one of the balls 22 is sunk into one of the pockets 16, the ball 22 drops onto the shelf 30. The shelf 30 is slanted downward towards the ball retrieval bin 14. Thus, upon catching the balls 22, said balls 22 are biased downward along the shelf 30, and ultimately fall into the ball retrieval bin 14, where the balls 22 can be retrieved for further play. The bin 14 has an outer lip 14L that prevents the balls 22 therein from falling out of said bin 14.

The plurality of pockets 16 are scattered around the table top 12T in a random pattern. The pockets 16 are all positioned away from the rails 12A, 12B. Each pocket 16 is dimensioned for accommodating one of the balls 22 therethrough. In a preferred embodiment, there are five (5) pockets 16. The corresponding bumper 18 is positioned adjacent to each pocket 16, each bumper 18 labeled with a number 18N, namely "1", "2", "3", "4", and "5". Further, an indicator 20 also is positioned adjacent to each pocket 16, the indicator 20 situated opposite the bumper 16, across the pocket 16. The indicators 20 are flush with the table top 12T, thereby not interfering with the playing of the game. The purpose of the indicators 20 is to determine the positioning of the ball 22 during play of the game, as will be described in greater detail hereinafter. Further, a starting line 24 extends horizontally across the table top 12T between the table long rails 12A.

The plurality of color-coded balls 22 are also labeled with numbers 22N similar to the bumper numbers 18N, namely "1", "2", "3", "4", and "5". In the preferred embodiment illustrated in the figures, the game system 10 has a total of twenty-five (25) balls 22, including five (5) sets of five (5) balls 22. Each set of balls 22 has the same color and includes the numbers "1"–"5". By way of example, one set of balls 22 is all red, one set is all black, one set is all white, one set is all green, and one set is all yellow. Additional sets may be included and different colors may be employed.

Figure 3:
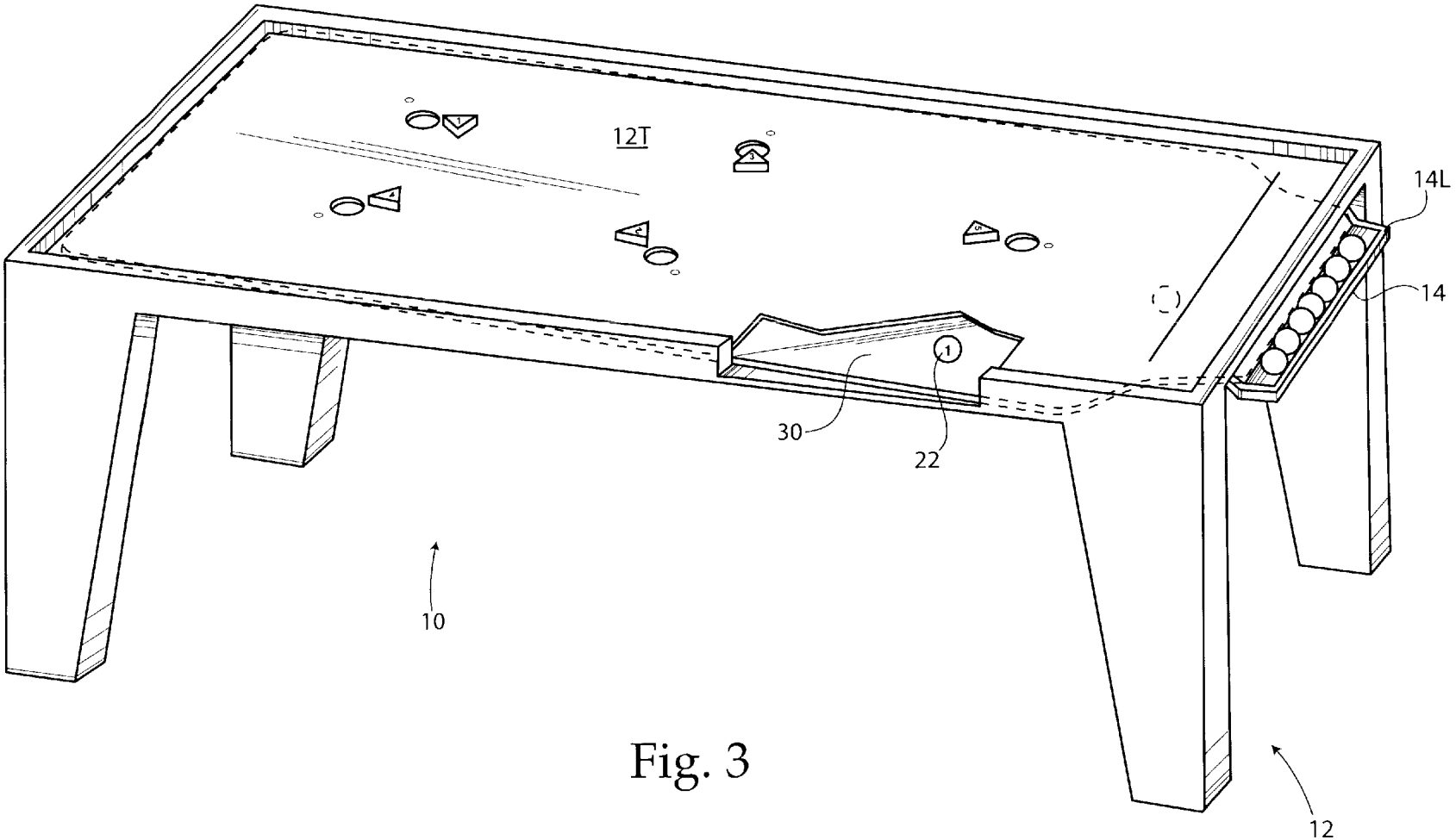
FIG. 3 is a perspective view of the game table with a portion broken away illustrating the ball catching structure positioned below the table top.

During play, at least two players 26 are needed in order to play the game. The game is begun by determining the order in which the players will take turns and having each player 26 choose one set of balls 22 with which to play the game. The ball 22 numbered "1" is placed along the starting line 24 at any point thereon. The player 26 then proceeds to employ a cue stick 28 to hit the ball 22 from the starting line 24 towards and ultimately into the pocket 16 having the bumper 18 numbered "1". The players 26 alternate hitting their balls 22, each player 26 taking as many turns hitting his ball 22 as necessary to sink the ball 22 in the appropriate pocket 16. In attempting to sink the ball 22, the player 26 may choose to hit the ball 22 directly into the pocket 16 if there is nothing obstructing the path, or alternatively the player 26 may "bank" the ball 22. As illustrated in FIG. 3, "banking" involves ricocheting the ball 22 off of one of the rails 12A, 12B or another ball 22.

Once the ball 22 is sunk into the correct pocket 16, the player 26 places the next ball 22, namely the ball 22 numbered "2", on the indicator 20 adjacent to the pocket 16 with a number one less than the ball 22 (e.g. adjacent pocket "1"). The player 26 then proceeds to hit that ball 22 into its similarly numbered pocket 16. These steps are continued until all five balls 22 have been hit into the appropriate pockets 16. The game is won by the first player successful in sinking all of the balls 22 into the correctly numbered pockets 16.

As part of the strategy of the game, it is permissible to hit another player's ball 22 away from the pocket 16 in an attempt to thwart the opponent from sinking his ball 22. This may be done by banking the player's ball 22 into the opponent's ball. If the player 26 is successful, said player 26 is rewarded with an additional turn. If the player 26 is unsuccessful in banking, the player's 26 turn is over.

The game may also be played with points. The above described method of play is employed, and points are rewarded after each ball 22 is sunk into the correct pocket 16. By way of example, when the player 26 sinks ball "1" into the correct pocket 16, he receives one point. The sinking of ball "2" earns two points, ball "3" earns three points, ball "4" earns four points, and ball "5" earns five points. A predetermined number of games may be played, and at the end of play, the players 26 add up their points to derive a winner. The player 26 with the most number of points is the winner of the game.

In conclusion, herein is presented a billiard type game system that comprises apparatus for playing the game and a method of playing the game. The invention is illustrated by example in the drawing figures, and throughout the written description. It should be understood that numerous variations are possible, while adhering to the inventive concept. Such variations are contemplated as being a part of the present invention.

What is claimed is:

1. A method of playing a billiard type game by at least two players, the game apparatus comprising a game table having a table top, side rails bordering the table top, a starting line on the table top, a plurality of consecutively numbered vertical pockets in the table top, a plurality of bumpers wherein the number of bumpers corresponds directly to the number of pockets, each bumper is positioned adjacent to the pocket, and each bumper labeled with the number of the adjacent pocket, an indicator positioned on the table top adjacent to each pocket across from the bumper, a plurality of sets of color-coded balls, each set having one ball labeled with the same number as each of the pockets, a cue stick for use by each player, comprising the steps of:

a) selecting the number of players to engage in the game;

b) selecting an order in which the players will take turns being the current player;

c) selecting one set of balls for each player;

d) placing the ball numbered "1" on the starting line by the current player;

e) hitting the ball by the current player towards the pocket having the appropriately numbered bumper with the cue stick;

f) rewarding the player with an additional turn when the player:

i) banks the ball by ricocheting the ball off of one of the table side rails into another player's ball; and ii) hits another player's ball away from the pocket;

g) alternating the current player among the players such that each player initially performs step (c), and then the players alternatively repeat step (d) unless the current player sinks the ball into the pocket associated with that ball;

h) placing the next consecutively numbered ball of the current player on the indicator adjacent to the pocket into which the ball was just sunk;

i) repeating steps (e) through (h) with each consecutively numbered ball until all of the balls in the set of one of the players have been sunk into the appropriate pockets in the correct order; and j) determining a winner of the game.

2. The method of playing a billiard type game as recited in claim 1, wherein the step of selecting the number of players to engage in the game is determined by the number of sets of balls available.

3. The method of playing a billiard type game as recited in claim 2, wherein the step of determining a winner of the game is further defined by the first player successful in sinking all of the balls in the player's set of balls into the correctly numbered pockets in the correct order.

4. The method of playing a billiard type game as recited in claim 2, wherein the step of selecting one set of balls for each player is followed by the steps of:

(i) assigning a predetermined and non-equal number of points to each ball, and (ii) predetermining a number of consecutive games to be played; and wherein the step of determining the winner of the game is made by determining which player has the most points which is made by tallying each player's points by:

(i) rewarding points for each ball sunk into the correct pocket according to its predetermined point value.

* * * * *